US005702208A

United States Patent [19]

Hilfiker et al.

[11] Patent Number: 5,702,208

[45] Date of Patent: Dec. 30, 1997

[54] GRID-LOCKED BLOCK PANEL SYSTEM

[76] Inventors: William K. Hilfiker, 3718 Lakeridge Dr., Grapevine, Tex. 76051; Thomas P. Taylor, 2500 Cranberry La., Euless, Tex. 76039

[21] Appl. No.: 585,568

[22] Filed: Jan. 16, 1996

Related U.S. Application Data

[63] Continuation-in-part of Ser. No. 252,738, Jun. 2, 1994, Pat. No. 5,484,235.

[51] Int. Cl.[6] ..... E02B 3/12

[52] U.S. Cl. ..... 405/258; 404/40; 405/16; 405/20; 405/262; 405/284

[58] Field of Search ..... 405/284, 285, 405/286, 262, 258, 17, 18, 19, 20; 404/35, 40

[56] References Cited

U.S. PATENT DOCUMENTS

| | | | |
|---|---|---|---|
| 991,041 | 5/1911 | Toennes | 405/20 |
| 1,144,143 | 6/1915 | McGillivray | 405/20 |
| 1,959,816 | 5/1934 | Crum | 72/30 |
| 1,992,785 | 2/1935 | Steuer | 72/40 |
| 2,327,640 | 8/1943 | Hendry | 404/40 X |
| 2,552,712 | 5/1951 | Ellis | 72/41 |
| 2,703,963 | 3/1955 | Gutierrez | 405/262 |
| 2,881,614 | 4/1959 | Preininger | 72/42 |
| 3,597,928 | 8/1971 | Pilaar | 405/20 |
| 3,998,022 | 12/1976 | Muse | 52/574 |
| 4,123,881 | 11/1978 | Muse | 52/100 |
| 4,286,895 | 9/1981 | Poli et al. | 405/17 |
| 4,324,508 | 4/1982 | Hilfiker et al. | 405/284 |
| 4,411,255 | 10/1983 | Lee | 126/429 |
| 4,651,975 | 3/1987 | Howell | 404/35 X |
| 4,661,023 | 4/1987 | Hilfiker | 405/262 |
| 4,664,552 | 5/1987 | Schaaf | 405/19 X |
| 4,920,712 | 5/1990 | Dean, Jr. | 52/169.4 |
| 5,257,880 | 11/1993 | Janopaul, Jr. | 405/284 |
| 5,474,405 | 12/1995 | Anderson et al. | 405/286 |

OTHER PUBLICATIONS

*Erosion Control*, Sep./Oct. 1995, p. 28, advertisement for American Excelsior Company.

Presto Products Company advertisement for GEOWEB.

*Erosion Control*, Sep./Oct. 1995, p. 30, EnviroGrid advertisement for Cellular Confinement System.

*Erosion Control*, Sep./Oct. 1995, p. 38, Manta Ray Earth Anchor Systems advertisement.

*Erosion Control*, Sep./Oct. 1995, p. 63, International Erosion Control Systems, LLC. advertisement for Cable Concrete.

*Erosion Control*, Nov./Dec. 1995, p. 26, Pavestone Co. advertisement.

Sweet's Engineering and Retrofit: Mechanical, Electrical, Civil/Structural 1993 Catalog File, published by McGraw-Hill (1993), Section 02276/ (KEY, ROC, GBR and AND) (*Earth Retainage, Buylines 2802* (*Keystone*), *6342* (*Rockwood*), *6578* (*Gravity*) *and 7682* (*Diamond*)).

*Primary Examiner*—Dennis L. Taylor

*Attorney, Agent, or Firm*—Limbach & Limbach L.L.P.

[57] ABSTRACT

Concrete blocks are formed with intersecting grooves in the underside thereof which assume aligned condition when the blocks are assembled into side by side relationship to form panels. Polymer or welded wire grids are received within the aligned grooves to hold the blocks in the panel configuration. The grids are held in elevated seated condition within the grooves during assembly of the blocks into the panel configuration. Stands or wire connectors may be provided for the latter purpose. In the preferred embodiment the blocks are L-shaped and formed with passages extending therethrough and the grooves intersect these passages. Grout or fill may be placed within the passages of the assembled panels. In certain embodiments, the blocks may be disposed in side-by-side relationship and stacked to form retaining walls for earthen formations, with rods received within the grooves of the blocks to hold the blocks in alignment and the grids extending from the blocks to serve as soil reinforcements.

55 Claims, 18 Drawing Sheets

B
B
12
60
58
58
58

GRID-LOCKED BLOCK PANEL SYSTEM

RELATED APPLICATION

This application is a continuation-in-part of application Ser. No. 08/252,738 for a RETAINING WALL SYSTEM filed by the inventors herein on Jun. 2, 1994, now U.S. Pat. No. 5,484,235.

BACKGROUND OF THE INVENTION

The present invention relates to an improved concrete block and grid structure and a method and apparatus for constructing panels of interlocked blocks from this structure and embodying such panels in the construction of support surfaces and channel liners for earthen formations and the construction of retaining walls for such formations. In its more specific aspects, the invention concerned with such blocks which have intersecting grooves formed in the undersurface thereof adapted to be engaged over a suspended gridwork which serves to hold assembled blocks in side-by-side relationship.

The prior art teaches concrete blocks formed with grooves which receive rod or clip like members to hold assembled blocks in aligned side-by-side relationship. U.S. Pat. Nos. 1,959,816 and 1,992,785 are typical of such constructions. The prior art also teaches the provision of T or Z shaped blocks which interlock and are held against separation by clips extending across grooves in the blocks; see for example U.S. Pat. Nos. 3,998,022 and 4,123,881. It is also known in the prior art to secure stacked face panels for earthen formations in aligned condition through the provision of plates, rods and/or pins extending across the panels and to secure such panels to soil reinforcing gridworks embedded within the earthen formation being retained. U.S. Pat. Nos. 4,324,508 and 4,661,023 exemplify walls of the later type.

SUMMARY OF THE INVENTION

The present invention is concerned with an integrated concrete block erosion control system wherein the blocks are of an open celled configuration having grooves formed in the body thereof and extending upwardly into the blocks in intersecting relationship to the open cells. The grooves are arranged to complement a wire or polymer gridwork employed therewith so that the blocks may be assembled over the gridwork and held in side-by-side assembled relationship to form a panel comprised of juxtaposed blocks. In the preferred embodiment, at least certain of the blocks are L-shaped so as to interlock when assembled into side-by-side relationship. The gridworks may be held in suspended condition within the blocks by stands, clips and/or grouting. A channel liner formed of panels of the blocks may have dirt fill within the cells to provide for the growth of vegetation. In certain embodiments, barriers may be constructed on the top of a panel used as a channel liner to provide a hydraulic jump. In the preferred embodiment, a free draining material is provided under the panels.

The invention is also concerned with an integrated concrete block wall comprised of concrete blocks having grooves formed in the body thereof and extending upwardly or downwardly therein and relatively narrow gridworks complementally engagable in these grooves, with rods also received within these grooves to hold the gridworks in place and span adjacent blocks. With such an arrangement, the gridworks may be used for soil reinforcement of an earthen formation adjacent the wall. In certain embodiments, the ends of the gridworks received within the grooves of the rods are bent, and the rods are received over or under the bends to secure the gridworks to the block without stressing the transverse wires of the gridworks.

A principal object of the invention is to provide an improved block having intersecting grooves engagable over a gridwork to enable a plurality of such blocks to be assembled over the gridwork in side-by-side relationship and held together in a panel configuration by the gridwork.

Another object is to provide a panel constructed of such blocks which may be lifted into place as a unit.

Still another object is to provide a panel constructed of such blocks which may be used as a liner within an earthen channel for erosion control.

Another object is to provide a panel of such blocks which may be used as a support surface over an earthen formation and functions to distribute concentrated loads applied thereto over an extended area of the formation.

Yet another object is to provide an assembly of such blocks which may be used both for erosion control and in the construction of a retaining wall for an earthen formation.

Still another object of the invention is to provide a panel constructed of such blocks wherein the gridwork is held in suspended condition within the blocks by hangers extending over the blocks and into engagement with the gridwork.

A further object of the invention is to provide a panel constructed of such blocks wherein the blocks have open cells and the gridwork over which the blocks are assembled intersect these cells.

Yet another object related to the later object is to provide a panel constructed of such blocks wherein certain of the cells may be grouted to anchor the gridwork within the blocks.

Still a further object of the invention is to provide a wall constructed of concrete blocks having grooves therein for the complemental receipt of gridworks which may be used for soil reinforcement and rods received within the grooves to hold the gridworks in place and span adjacent blocks.

These and other objects will become more apparent when viewed in light of the accompanying drawings and the following description.

DESCRIPTION OF THE PREFERRED EMBODIMENT

Figure 1:
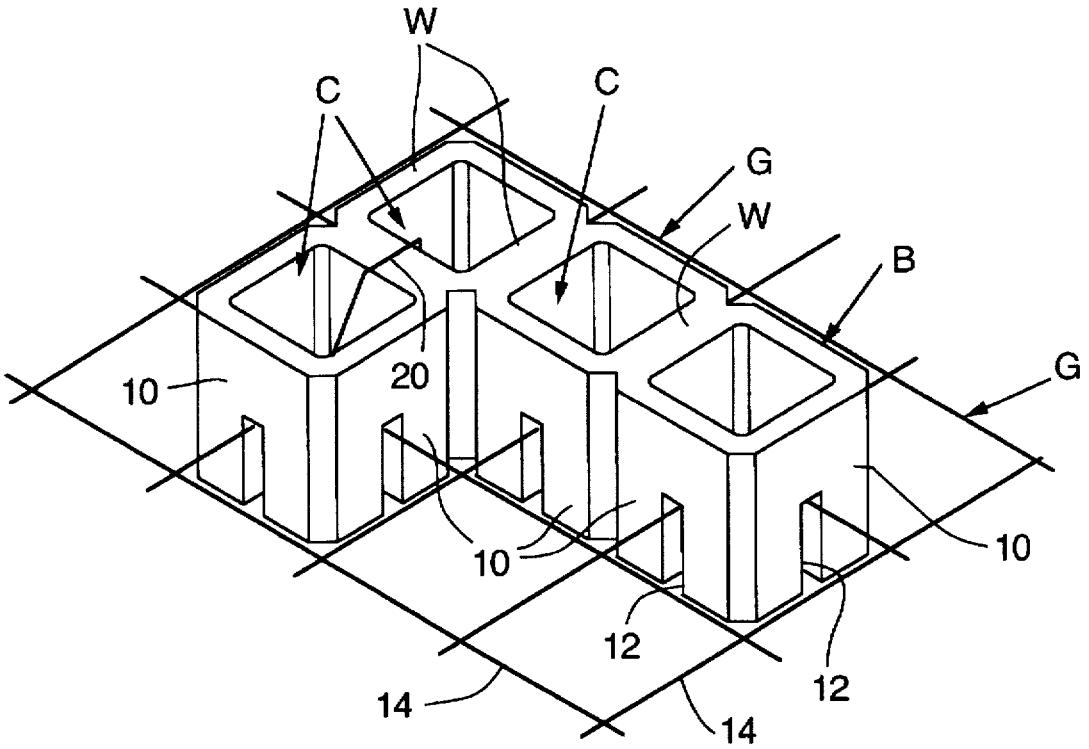
FIG. 1 is a perspective view of a block constructed according the present invention with a gridwork suspended within the block by a hanger.

Referring now to FIG. 1, an L shaped block B constructed according to the present invention is shown therein assembled over a suspended gridwork G. The block G is fabricated of a cementious material such as concrete and is formed with open cells C extending therethrough from top to bottom. The respective cells are separated from one another by webs W. Each cell of the L-shaped block B is of a generally rectangular cross-section, with one or more walls provided by the webs W and the remaining walls 10 being disposed on the outside of the block. Grooves 12 extend upwardly through the block in intersecting relationship to the cells C. The grooves 12 have a height equal to approximately one-half the depth of the block.

The gridwork G may be of a welded wire construction, or a polymeric "geogrid" construction. In either event, it is comprised of intersecting elements 14 proportioned and spaced for receipt in the intersecting grooves 14, as may be seen from FIGS. 1 and 2. There it will also be seen that the intersecting elements 14 are disposed at right angles relative to one another and define a square space therebetween.

Figure 2:
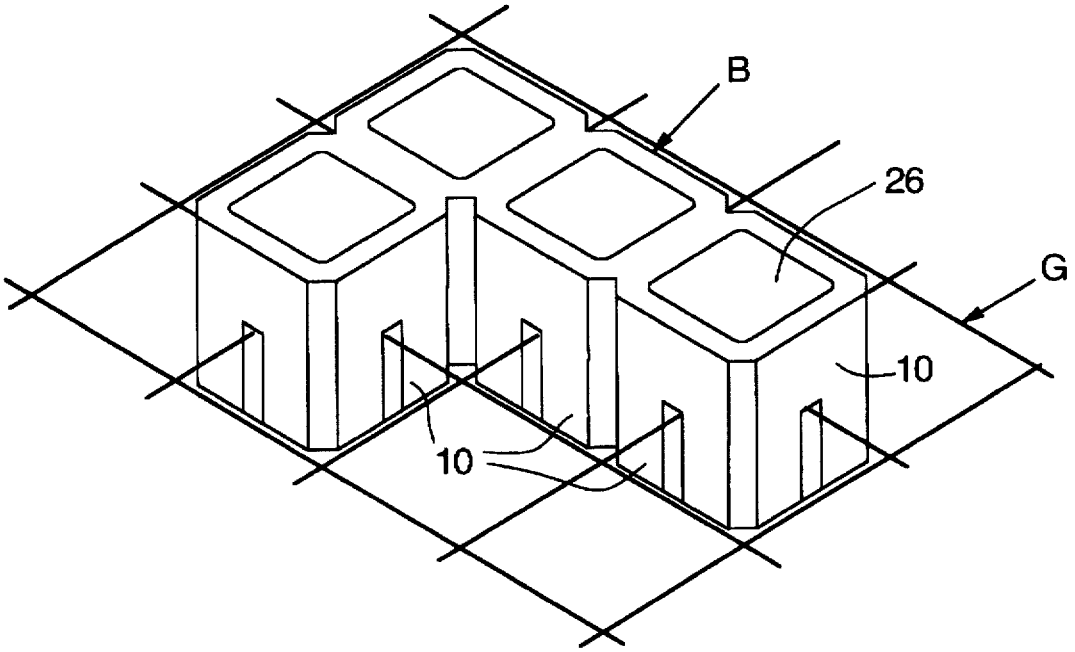
FIG. 2 is a perspective view similar to FIG. 1 showing a block constructed according to the present invention with a gridwork held in place suspended within the block by grouting.
Figure 3:
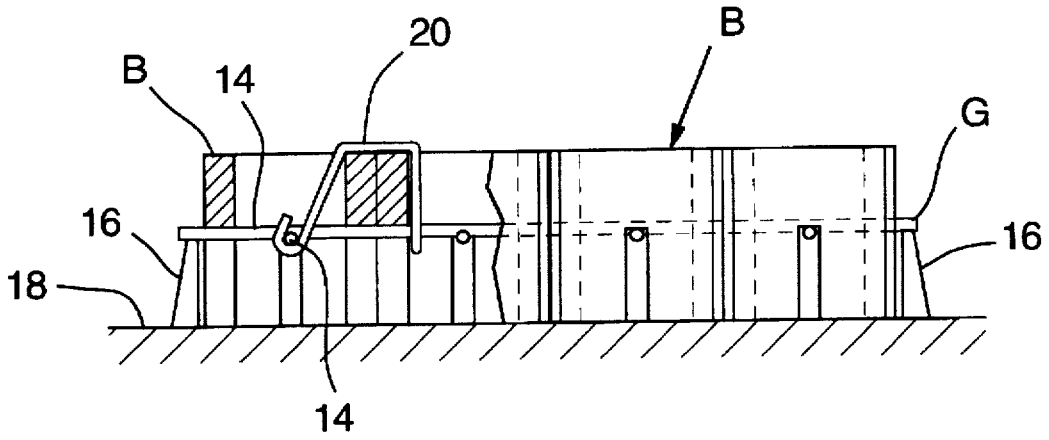
FIG. 3 is a elevational view, with parts thereof broken away for purposes of illustration, of a panel assembled from blocks constructed according to the present invention, with a hanger suspending a gridwork from the blocks.
Figure 4:
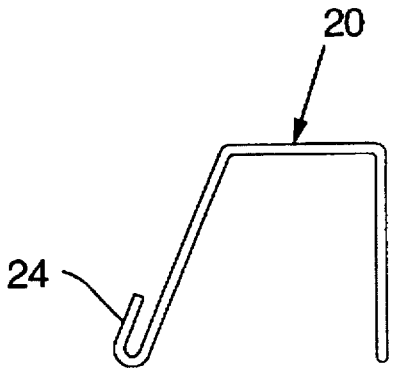
FIG. 4 is a side elevational view of the hanger shown in FIG. 3.
Figure 5:
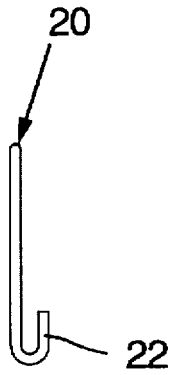
FIG. 5 is an edge elevational view of the hanger shown in FIG. 3.

FIGS. 1 and 2 illustrate that the gridwork G is suspended so as to be at the top of the grooves 12. During assembly of the blocks over the gridwork, such suspension may be temporarily provided by supporting the gridwork on stands 16, as depicted in FIG. 3. As thereshown, the stands are supported on a support surface 18 at an elevation approximately equal to the height of the grooves 12. FIG. 3 shows the blocks B engaged over the gridwork and supported on the surface 18. FIG. 3 also illustrates a wire connector 20 extending over a pair of juxtaposed blocks B. The connector 20 serves as a hanger for the gridwork and engages under the intersecting wires of the gridwork to either side of the blocks over which the connector extends. A first hook 22 (see FIG. 5) is formed on the connector for engagement over the wire 14 extending lengthwise as viewed in FIG. 3. A second hook 24 formed on the end of the connector 20 opposite the hook 22 engages over the wire 14 extending normal to the page, as viewed in FIG. 3. In applying the hanger, the hook 22 would first be engaged and the end of the connector 20 formed with the hook 24 would be bent downwardly and engaged under the element 14 therefor.

It should be appreciated that the connector 20 is engaged over the blocks and under the gridwork after the blocks are in place on the suspended gridwork, as shown in FIG. 3. Once the connector is so placed and the gridwork is suspended thereby, support of the gridwork is no longer dependent upon the stands 16. FIG. 1 also shows a gridwork G supported by a connector 20. FIG. 2 shows the cells of the block B filled with cement grout 26 to hold the gridwork in place. The grout serves as a concrete connection between the gridwork and the block and may be used in place of or in addition to the connectors 20.

Figure 6:
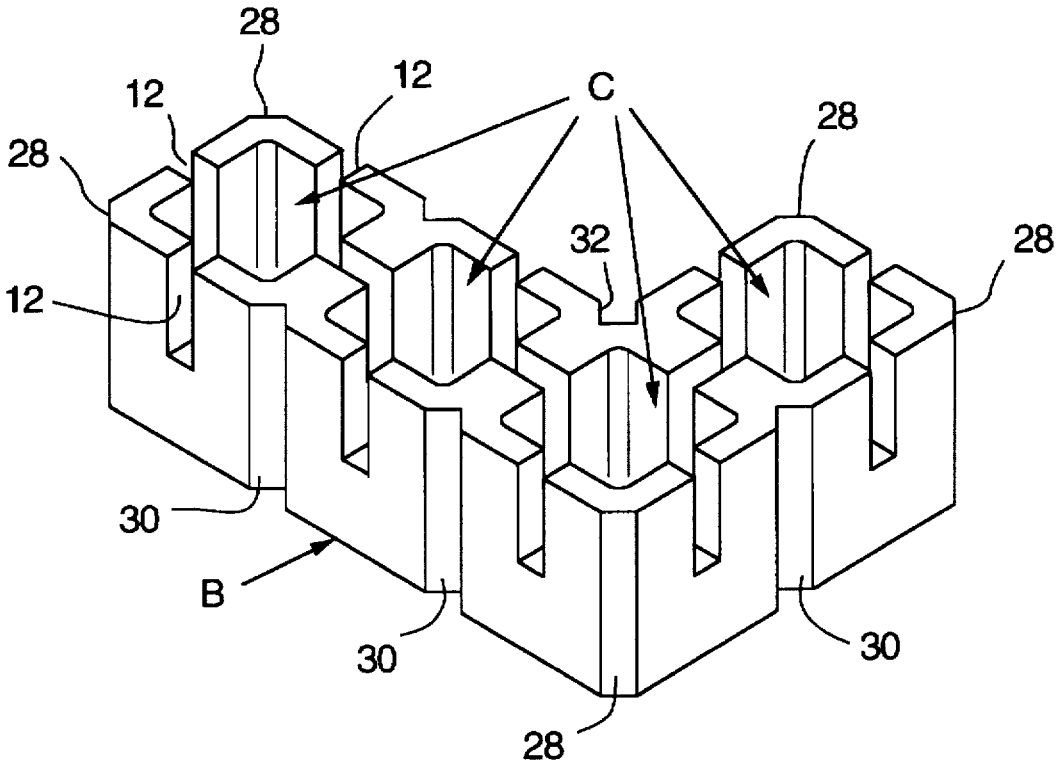
FIG. 6 is a perspective view of a block constructed according to the present invention, inverted to show the grooves within the block extending upwardly.

FIG. 6 shows the L-shaped block B inverted with the grooves facing upwardly. As thereshown, it will be seen that the outside corners of the block are formed with chamfers 28 and that the outside surfaces of the block are formed with V-shaped grooves 30 between the cells C. Also thereshown it will be seen that a generally rectangular groove 32 is formed in the outside surface of the block between the legs of the block which make up the L-shape. The chamfers 28 and the grooves 30 and 32 facilitate nesting of the blocks into an assembled panel as shown in FIG. 7 and provide generally rectangular passages which extend through the panel.

Figure 7:
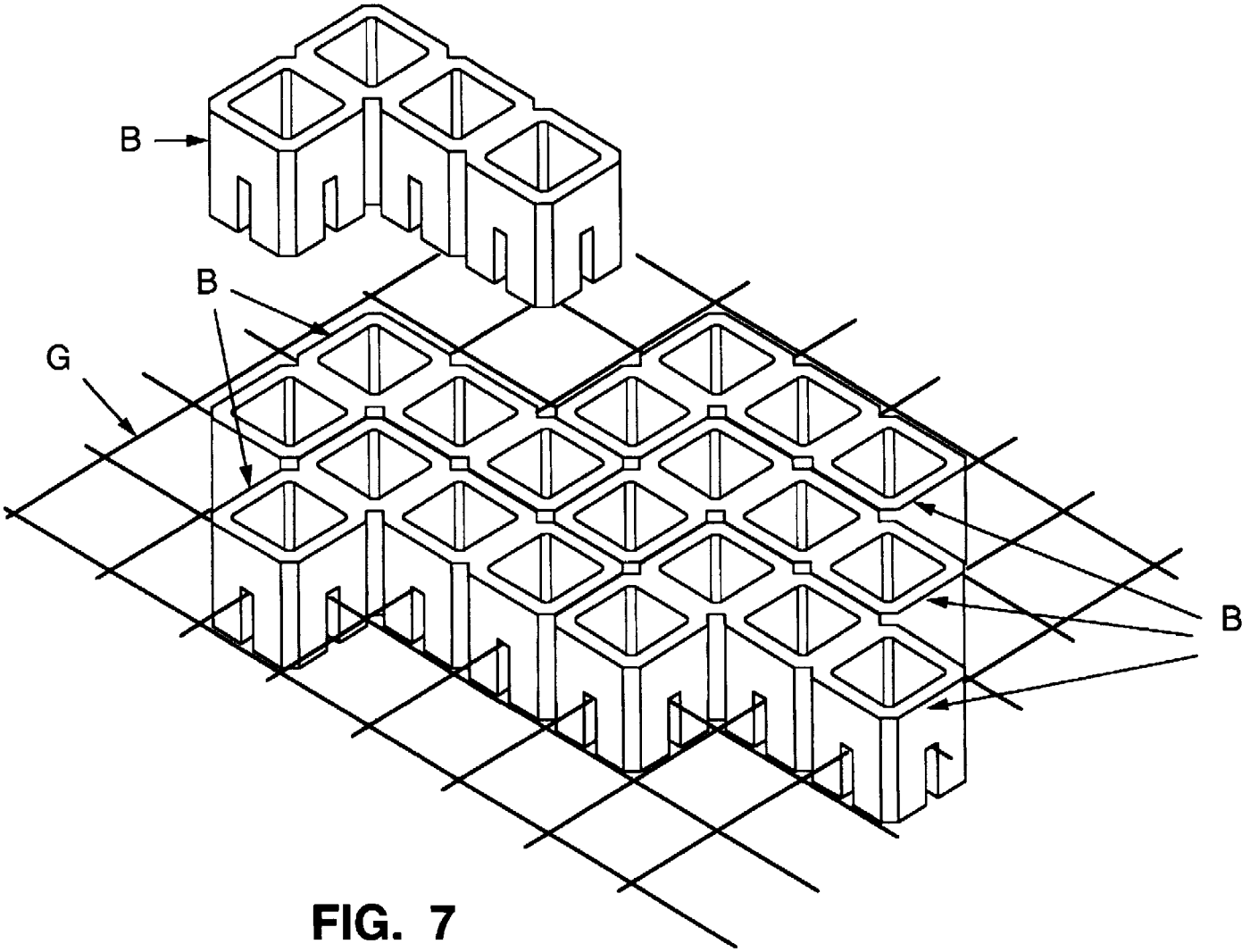
FIG. 7 is a perspective view of a panel being assembled over a gridwork from blocks constructed according to the present invention, with one of the blocks shown in exploded perspective as it would appear prior to being assembled into place on the gridwork.
Figure 8:
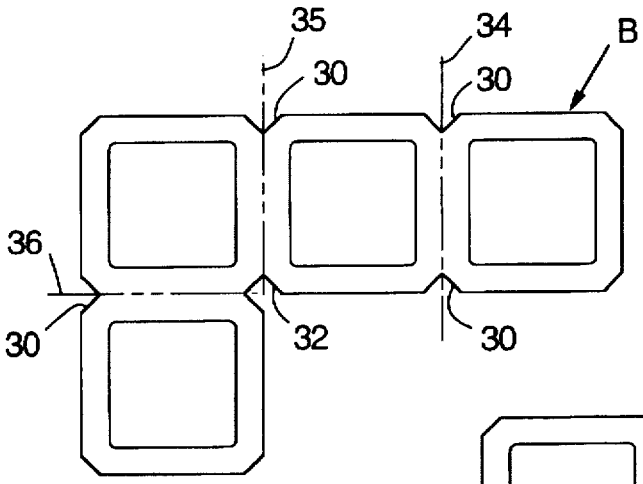
FIG. 8 is a plan view of a four cell L-shaped block constructed according to the present invention.
Figure 9:
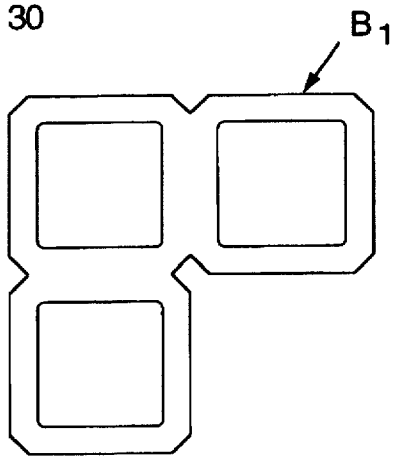
FIG. 9 is a plan view of a three cell L-shaped block constructed according the present invention.
Figure 10:
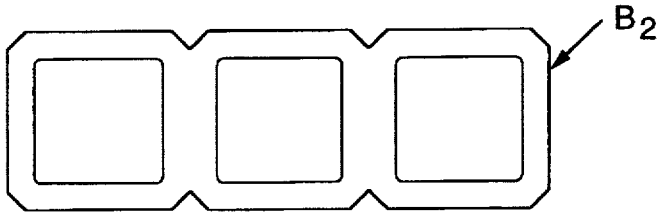
FIG. 10 is a plan view of three cell rectilinear block constructed according to the present invention.
Figure 11:
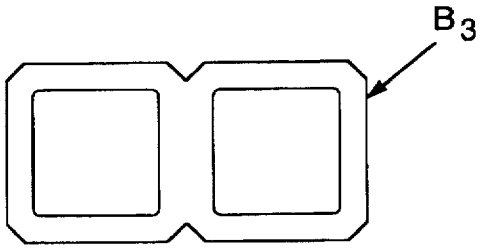
FIG. 11 is a plan view of a two cell rectilinear block constructed according to the present invention.
Figure 12:
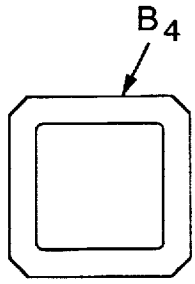
FIG. 12 is a plan view of a one cell rectilinear block constructed according the present invention.

As shown in FIG. 7, only L-shaped four cell blocks of the type shown in FIGS. 1–6 have been used. The block shown in exploded perspective in FIG. 7 is in the process of being placed. It will be appreciated that the resulting panel cannot completely fill the rectangular configuration of the gridwork G shown in FIG. 7. This results because the four cell L-shaped blocks, by themselves, are incapable of being assembled into a composite shape corresponding to the rectangular shape of the gridwork. To provide such a composite shape, ideally a combination of blocks having the shape seen in FIGS. 8–12 need to be provided. The block B of FIG. 8 is the same L-shaped block which has been described previously. The block $B_1$ of FIG. 9 is a L-shaped block comprised of three cells only. The block $B_2$ of FIG. 10 is of a rectilinear shape comprising three cells. The block $B_3$ of FIG. 11 is a rectilinear block comprised of two cells and the block $B_4$ of FIG. 12 is comprised of only one cell. The different block configurations $B_1$, $B_2$, $B_3$ and $B_4$ may be formed by breaking a block B along the cutlines 34, 35, and 36 shown in FIG. 8. The grooves 30 and 32 facilitate breaking along the cutlines. As an alternative, the blocks $B_1$, $B_2$, $B_3$ and $B_4$ can be initially molded in their final configuration.

Figure 13:
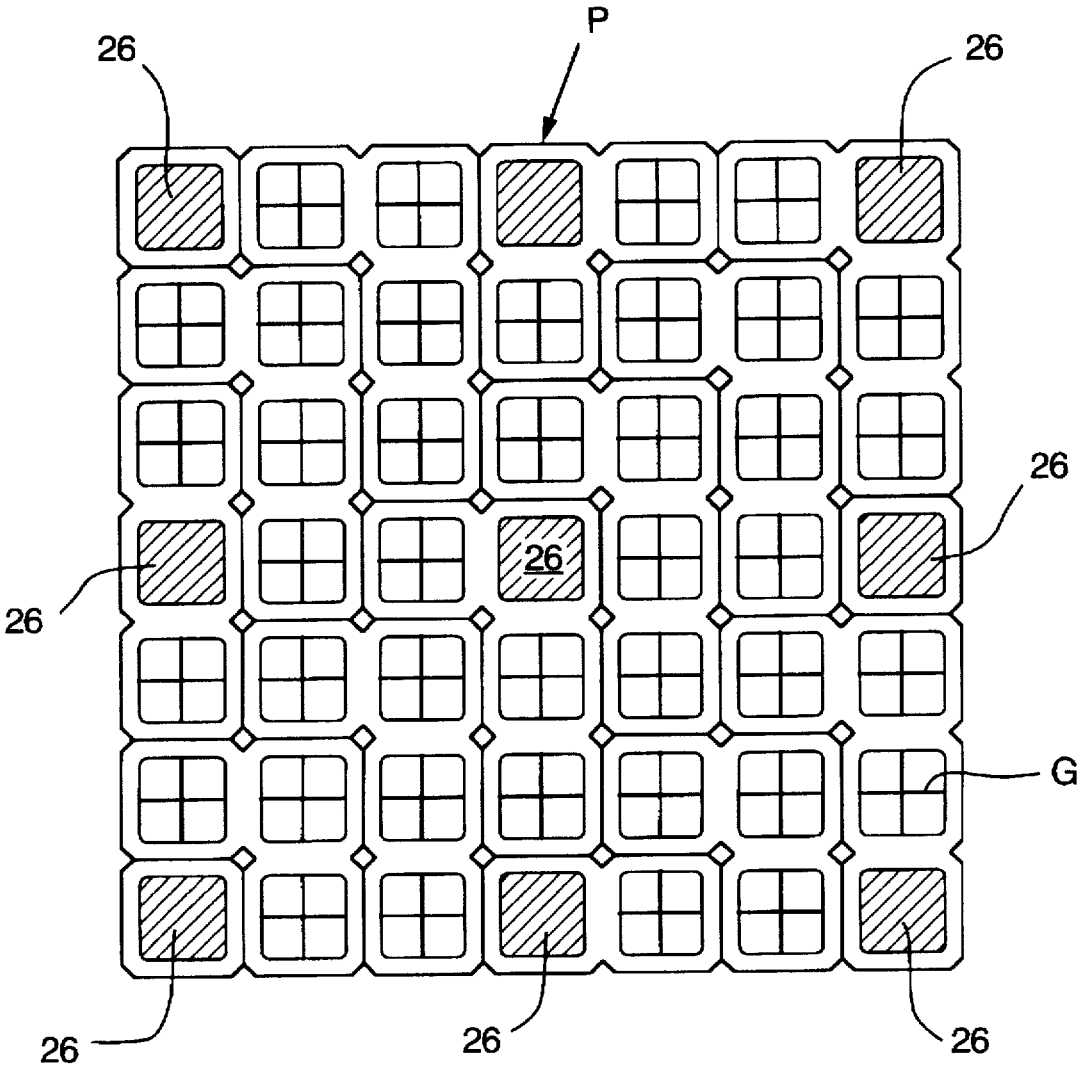
FIG. 13 is a plan view of rectangular panel assembled from blocks constructed according to FIGS. 8–12, with a gridwork shown in place within the blocks and certain cells of the blocks grouted.

FIG. 13 shows blocks B, $B_1$, $B_2$, $B_3$ and $B_4$ assembled into a full rectangular panel over a gridwork G. As thereshown, the corner cells and the cells midway of each side of the panel and in the center of the panel are filled with cement grout 26. The resulting panel is thus locked to the gridwork and the blocks within the panel interlock with one another.

Figure 14:
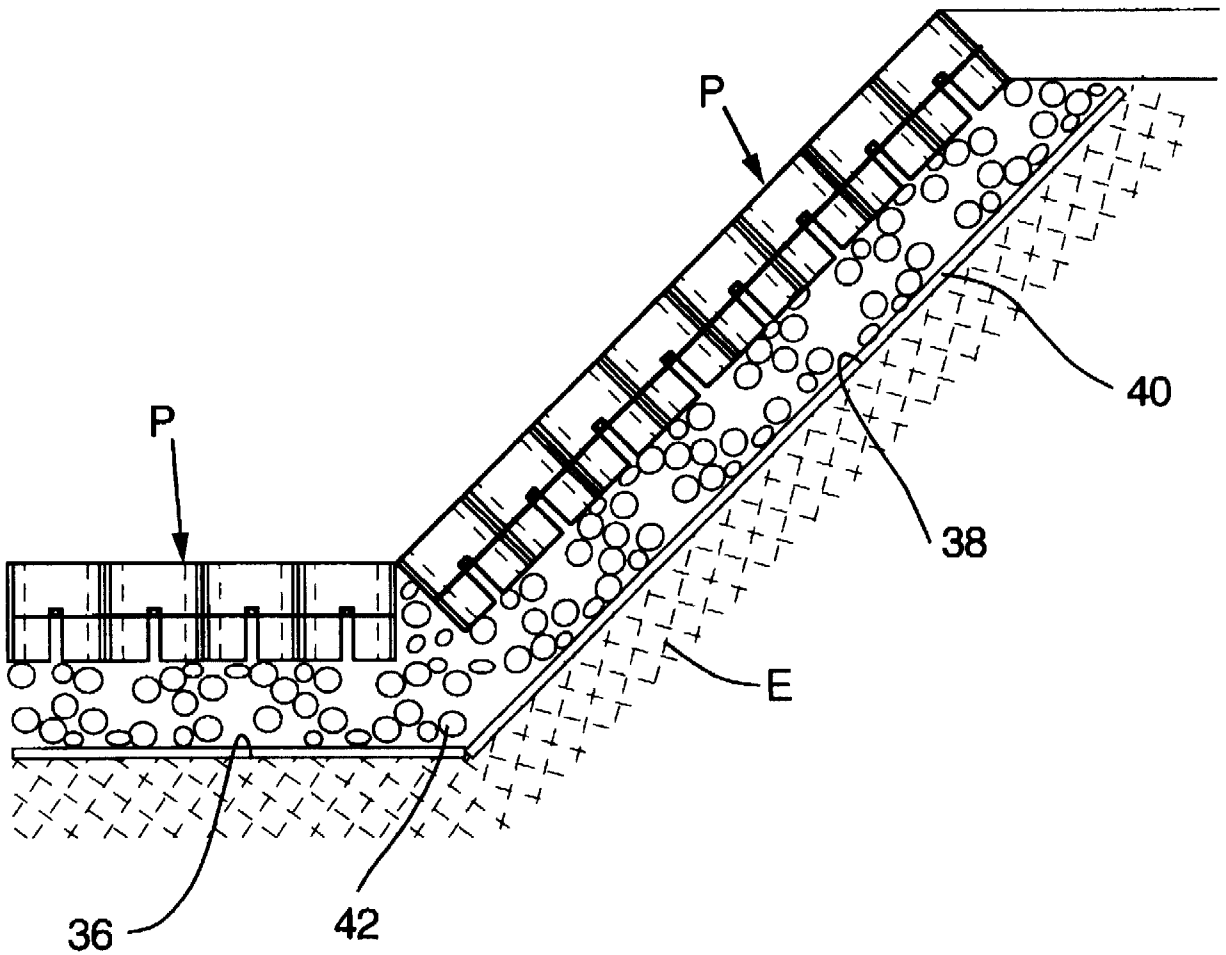
FIG. 14 is a cross-sectional elevational view of an earthen channel lined with panels assembled from blocks constructed according to the present invention, with drain rocks shown beneath the panels.

FIG. 14 shows block panels constructed according to the present invention assembled into place to form an erosion resistant liner for a channel within an earthen formation. The panels, designated P, may be constructed according to FIG. 13. The earthen formation is designated E and is shown as having a generally horizontal lower surface 36 and a sloped side surface 38. It should be appreciated that FIG. 14 depicts only one half of the channel and that the other half would extend to the left of what is shown in FIG. 14 and be a mirror image thereof. The earthen channel is covered with filter fabric 40 having drain rock 42 disposed thereover. The drain rock serves to support the panels P in spaced relationship to the earthen formation.

Figure 15:
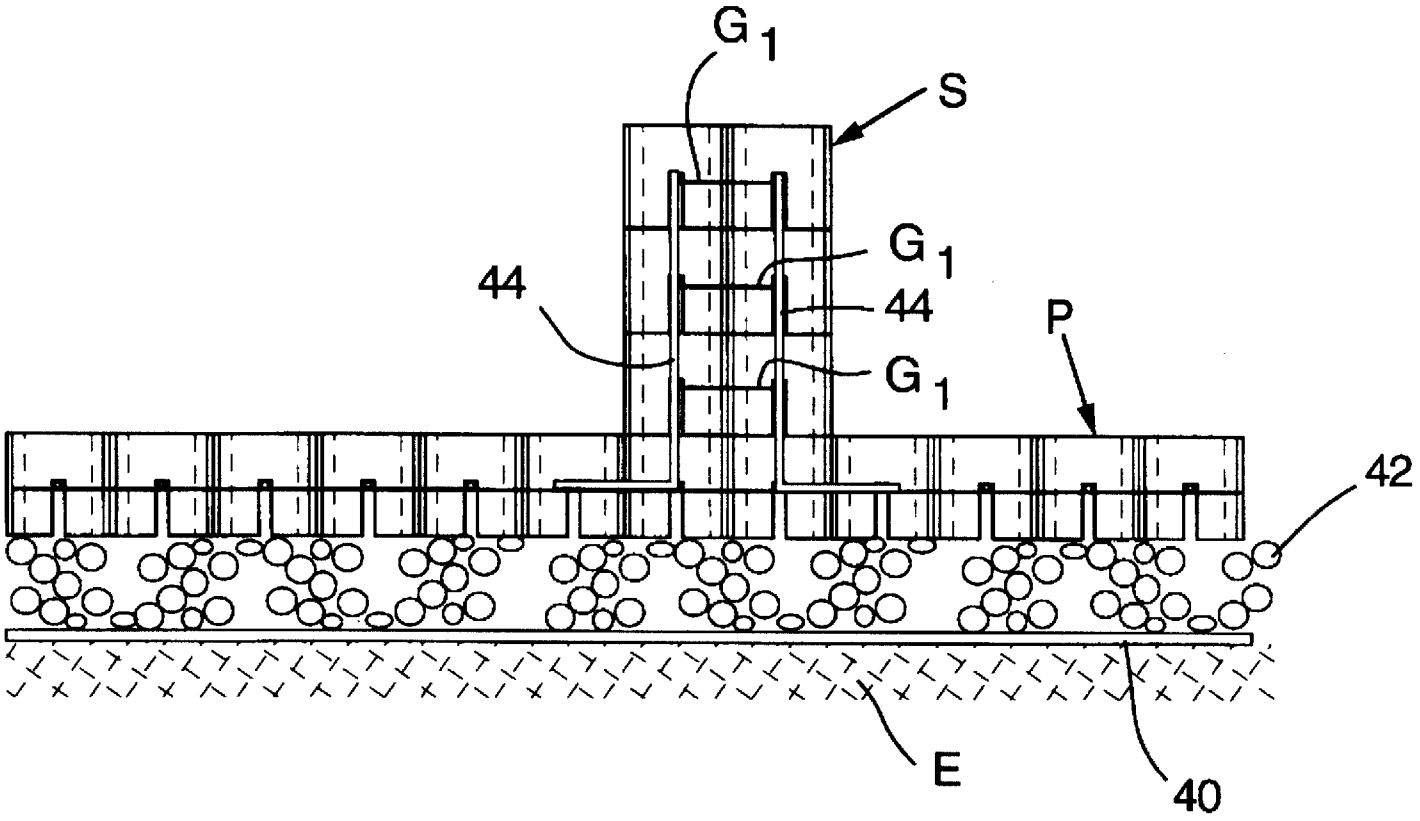
FIG. 15 is a cross-sectional elevational view of a panel constructed according to the present invention in place over an earthen formation, with drain rocks between the panel and the formation and a hydraulic jump barrier assembled from blocks constructed according to the present invention secured in place on the panel.

FIG. 15 shows a panel P supported above a generally horizontal portion of an earthen formation E and separated from the formation by filter fabric 40 and drain rock 42. As thereshown, the panel P is supported on the drain rock. A short stud wall S is fixed to and extends upwardly from the panel P. The stud wall is held in place by angle shaped reinforcing bars 44 extending through the blocks of the panel P and upwardly therefrom. The stud wall is comprised of blocks corresponding to any of the blocks B, $B_1$, $B_2$, $B_3$ or $B_4$ stacked over the bars 44 so that the bars extend through the cells of the blocks. Within each level of blocks of the stud wall, a short gridwork $G_1$ secures the blocks together. Ideally, grouting is placed within the cells of the blocks of the stud wall to provide an integral structure. The stud wall may be for any desired purpose. For example where the panels P are a part of a channel liner as shown in FIG. 14, the stud wall may serve as a hydraulic jump to break-up the flow of water through the channel.

Figure 16:
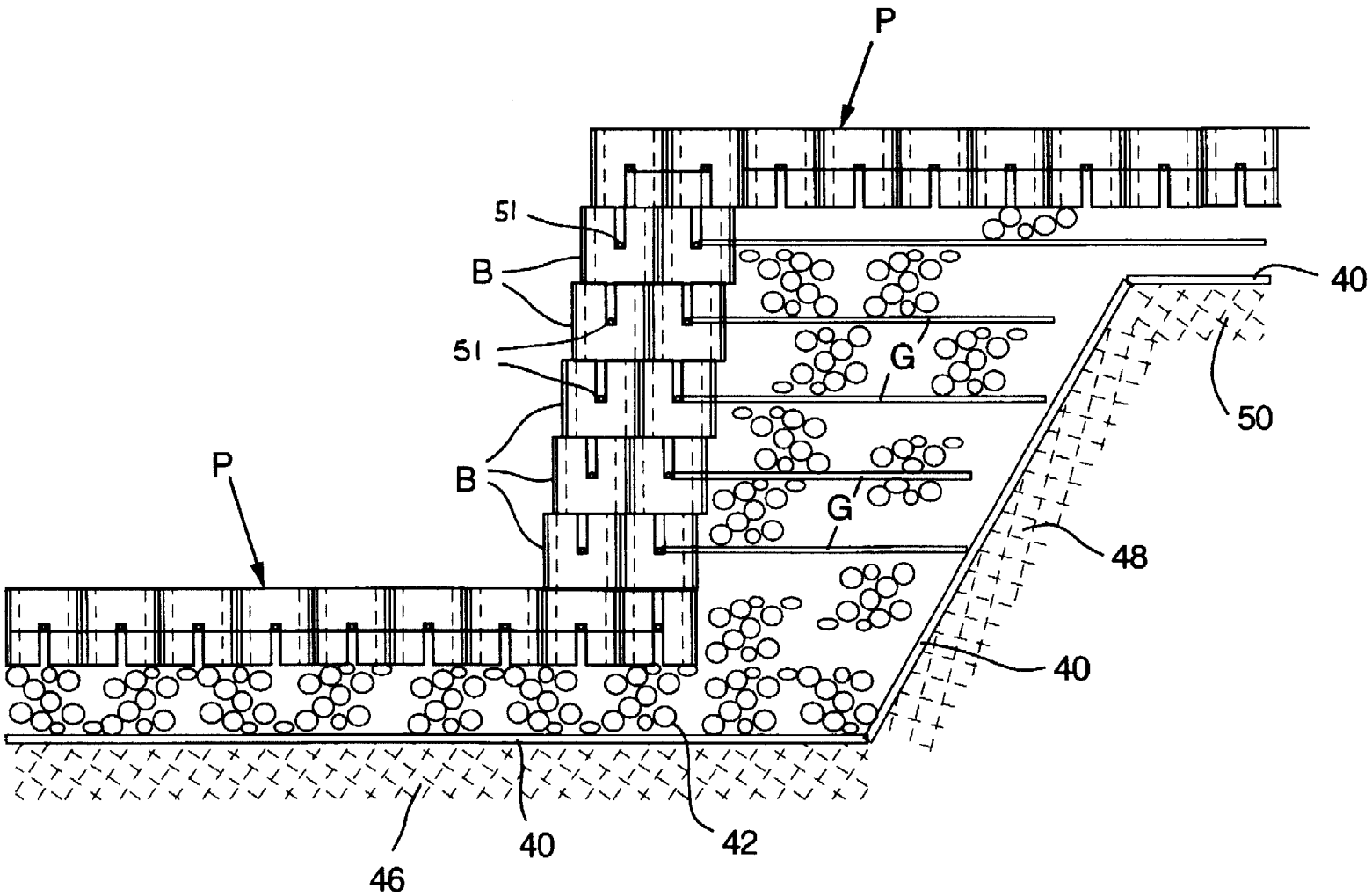
FIG. 16 is a cross-sectional elevational view of an earthen formation with retaining wall and capping structures assembled from blocks constructed according to the present invention.

FIG. 16 shows an earthen formation having a base portion 46 and an upstanding generally inclined portion 48 terminating in a top surface 50. As thereshown, the base portion P is covered with a panel P and a series of blocks B are stacked upon the later panel in inverted orientation in front of the upstanding portion 48. Each level of the inverted blocks has a gridwork G engaged in the grooves thereof and extending toward the upstanding portion 48. Rods 51 may also extend through the grooves of the inverted blocks. Filter fabric 40 is disposed over the top surface 50 and the surfaces of the base portion 46 and upstanding porion 48. Drain rock 42 is disposed between the base portion 46 and the panel P thereover, as well as between the upstanding portion 48 and the inverted blocks B. An upper panel P is disposed at the top of the inverted blocks B and extends over and in spaced relationship to the top surface 50. Drain rock is also disposed between the top surface 50 and the upper panel P.

The retaining wall arrangement of FIG. 16 acts much like a gravity wall, except that the gridworks G secured to the inverted blocks B serve to reinforce the drain rock and to help secure the inverted blocks in place. Although not illustrated, it is possible that the gridwork G secured to the inverted blocks B might extend into the earthen formation to serve to reinforce the formation and further secure the inverted blocks in place.

Figure 17:
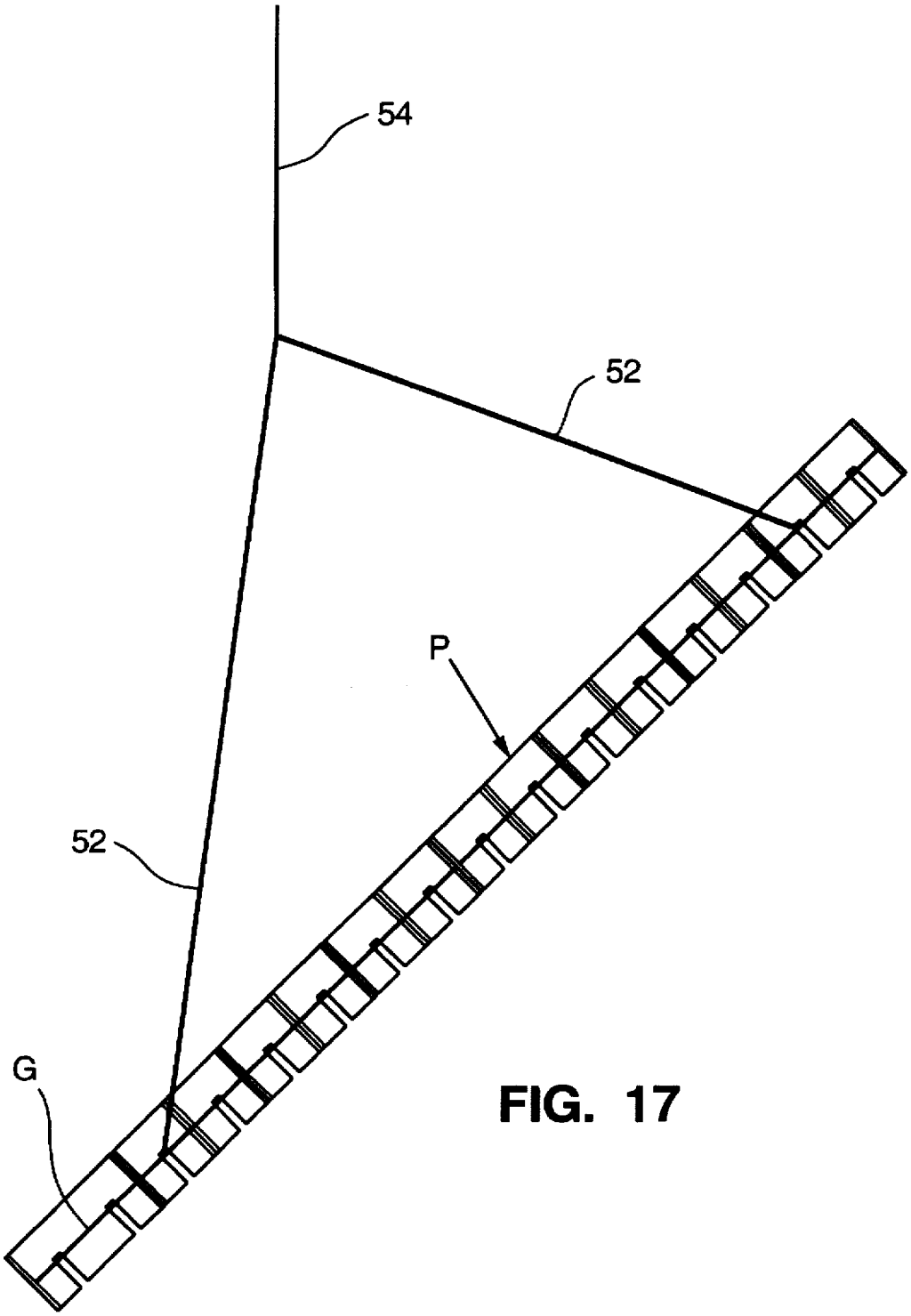
FIG. 17 is an elevational view of a panel constructed according to the present invention in the process of being elevated by hoisting cables secured to the gridwork of the panel.

FIG. 17 shows how a panel P may be lifted and placed as a unit. As thereshown, hoisting cables 52 are secured to the gridwork G at spaced locations and connected to a lifting line 54 which may be secured to a crane or the like. Although only two cables 52 are shown, it should be appreciated that a plurality of such cables would be provided, preferably in a triangulated pattern, so that the panel would remain in a stable condition and not swing around its connections to the panel during the lifting process. With the lifting arrangement shown in FIG. 16, a preassembled panel of blocks may be hoisted into an elevated condition and then moved to the site where it is to be placed and lowered into position.

Figure 18:
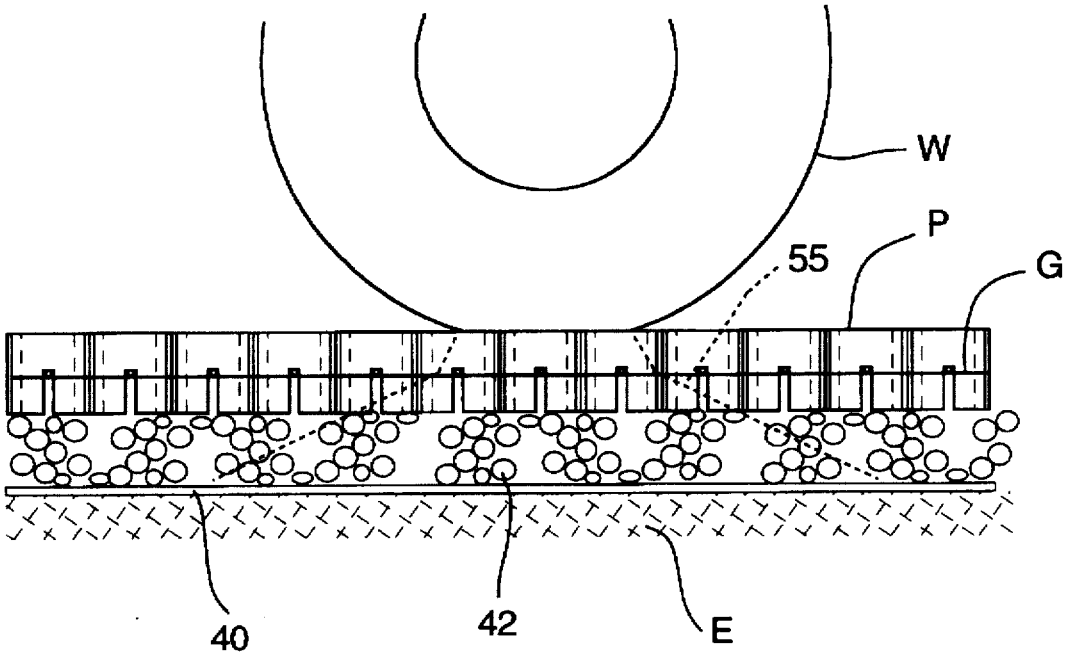
FIG. 18 is a cross-sectional elevational view of a panel constructed according to the present invention, illustrating loading of the panel by a concentrated load such as a wheel, and the manner in which loading forces are distributed through the panel and drain rock therebelow.

FIG. 18 depicts a panel P supported above the surface of an earthen formation E on drain rocks 42. Filter fabric 40 is disposed between the drain rocks and the formation. A concentrated load, as might be provided by a wheel W, is shown being applied to the surface of the panel. The dotted lines 55 diverging through the panel and the drain rock depict how the concentrated load is transferred to the earthen formation over an expanded area. Such divergent application of the load is ideal, in that it minimizes the likelihood of depression of the panel and the rock therebeneath as the result of the concentrated load.

Figure 19:
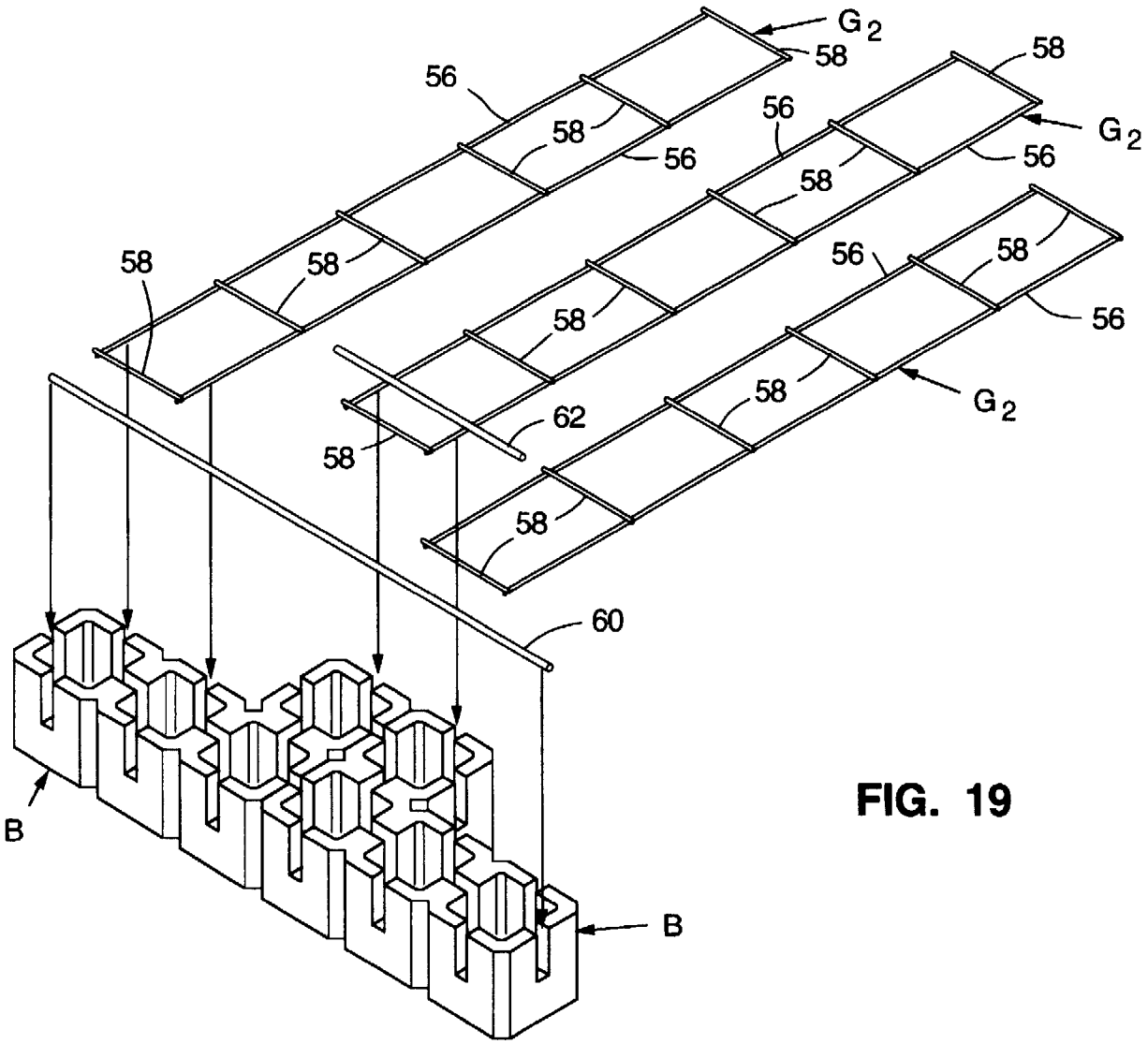
FIG. 19 is an exploded perspective view of an assembly of blocks constructed according to the present invention showing how relatively narrow soil reinforcing gridworks may be received within the blocks with retaining rods or bars engaged over the gridworks.
Figure 20:
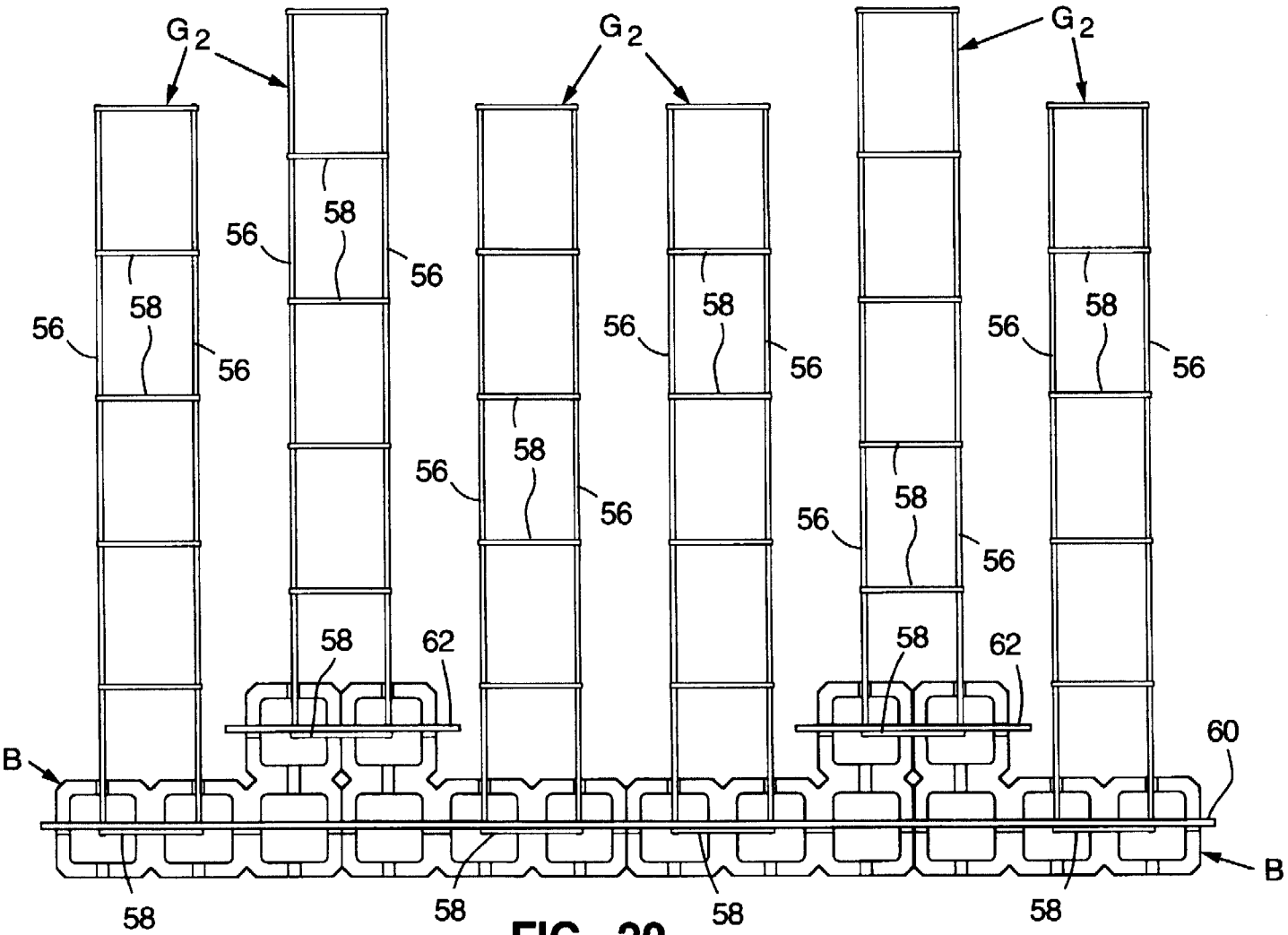
FIG. 20 is a plan view of an assembled wall constructed of blocks, gridworks and bars according to FIG. 19.

Two blocks B are shown assembled in end-to-end relationship in FIG. 19 to provide a wall wherein the grooves of the blocks extend upwardly and the short legs of their L-configuration extend to the back of the wall. Narrow gridworks G2 having longitudinal elements 56 spaced from one another by a distance equal to the space between adjacent grooves in the sides of the block are connected by cross-elements 58. The arrow lines in FIG. 19 depict how the gridworks G2 are engaged with the grooves within the blocks. Rods or bars 60 and 62 are disposed above the cross-elements 58 received within the block and proportioned for receipt within the grooves FIG. 20 shows a wall constructed according to FIG. 19 in fully assembled condition with the gridworks G2 and bars 60 and 62 in place. As there shown, distal cross-elements 58 of the gridworks are received within the grooves of the blocks and the bars 60 and 62 are disposed over the gridworks so as to be immediately behind these cross-elements. The latter arrangement can also be seen from FIG. 21 wherein the connection between a gridwork G2 and block B is illustrated.

FIG. 20 also shows that the bars 60 and 62 span adjacent blocks to hold the blocks in transverse alignment. The blocks may be further locked together by disposing grout within the cells C around the gridworks and the bars. It should also be appreciated that positioning of the bars 60 and 62 behind the distal cross-elements 58 distributes the load applied to the cross wires along their length and resists pull-out forces which may be applied to the gridworks.

Figure 21:
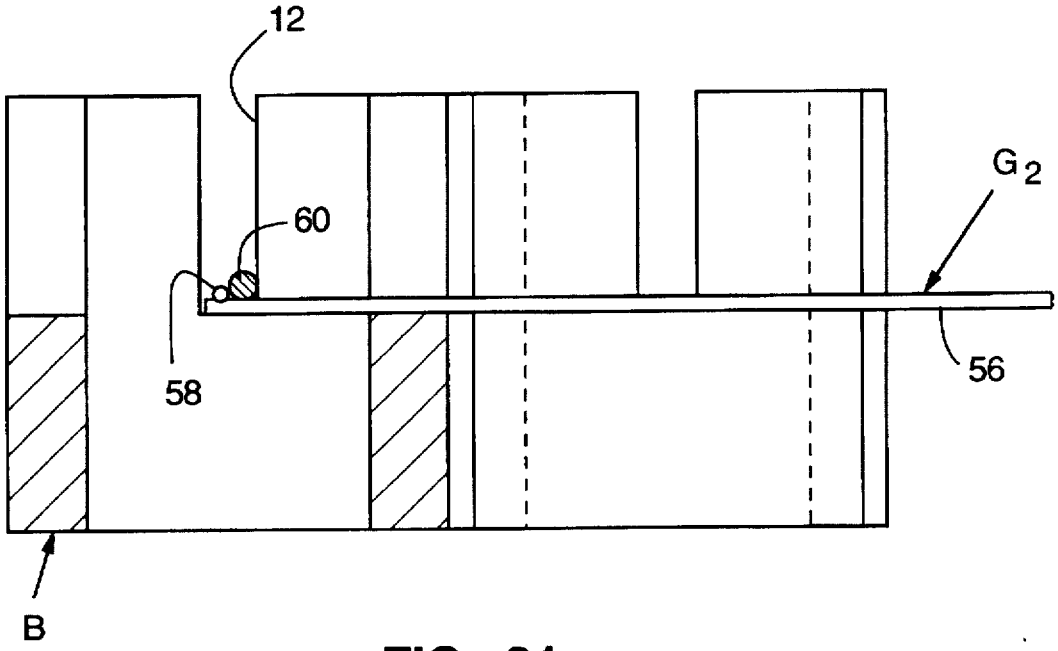
FIG. 21 is a cross-sectional elevational view showing the interengagement between the block, gridwork and bar in the FIG. 20 wall.

The assembled wall and gridwork structure of FIGS. 20 to 21 is ideally suited for use in constructing retaining walls for earthen formations wherein the gridworks are embedded within backfill at the face of the formation. Use of the relatively narrow soil reinforcing mats provided by the gridworks G2 has the advantage that it decreases the stiffness of the earthen mass and accommodates settlement of the earthen formation with a minimum of stress to the mats and the wall face provided by the blocks.

Figure 22:
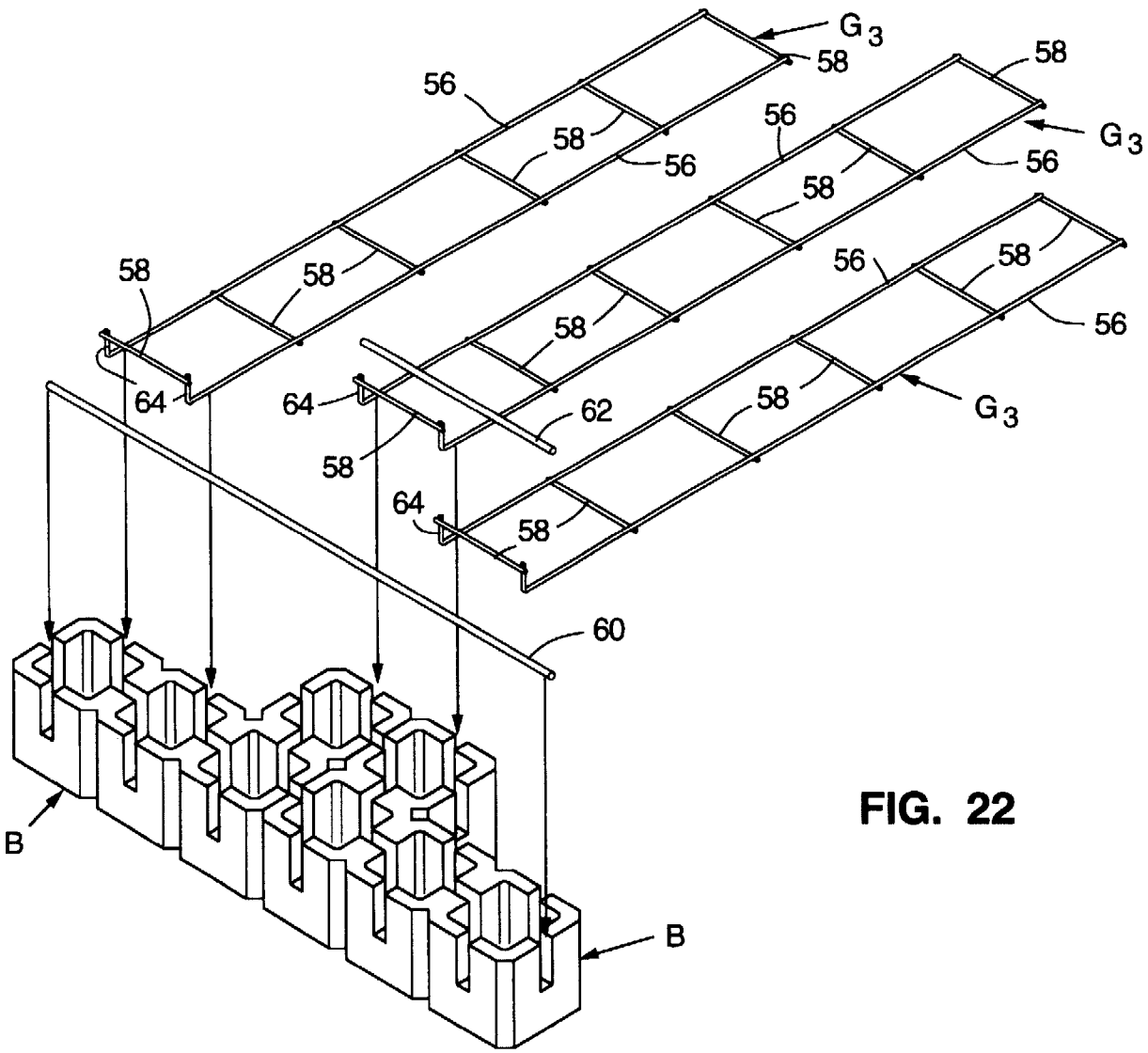
FIG. 22 is an exploded perspective view showing an assembly of blocks constructed according to the present invention with soil reinforcing gridworks engagable within the grooves of the blocks wherein the ends of the gridworks are bent upwardly and retaining bars are engaged thereover.
Figure 23:
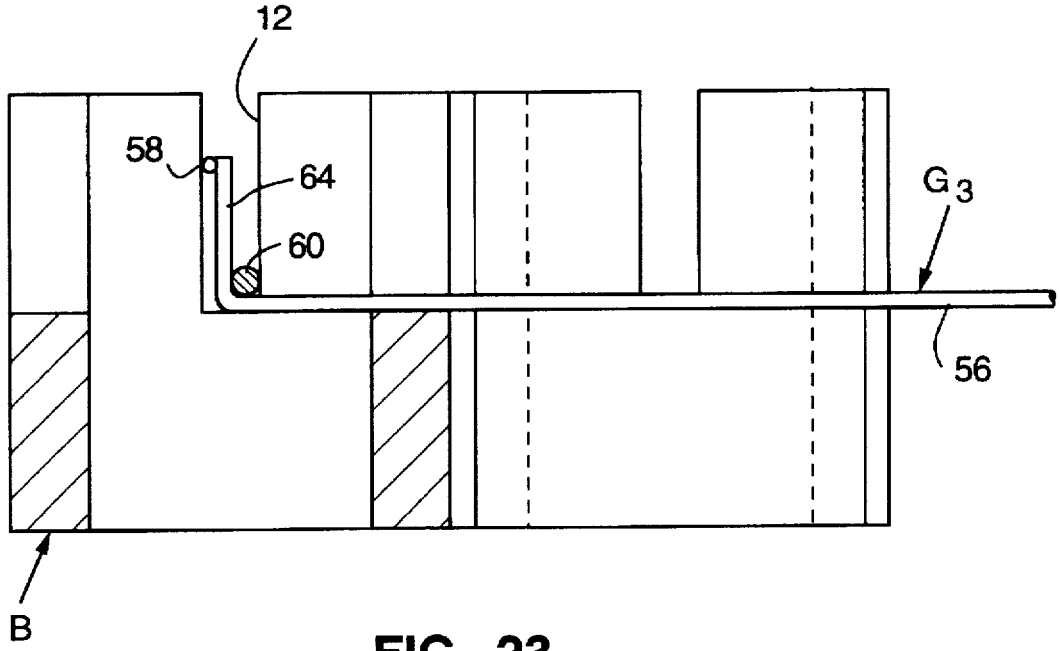
FIG. 23 is a cross-sectional elevational view showing the interengagement between the block, gridwork and bar of the FIG. 22 assembly.

The assembly shown in FIG. 22 is essentially the same as that shown in FIG. 19, except that the gridworks, designated G3, have bent-up portions 64 and the distal cross-elements 58 are secured across these portions. In the assembled position, as shown in FIG. 23, the bent-up portions 64 extend upwardly relative to the grooves 12 and the bars 60 are disposed within the grooves behind the bent-up portions. As the result of the latter arrangement, the bars 60 resist pull-out of the gridworks G2 from the blocks, without being dependent upon the strength of the connection between the distal cross-elements 58 and the longitudinal elements 56.

Figure 24:
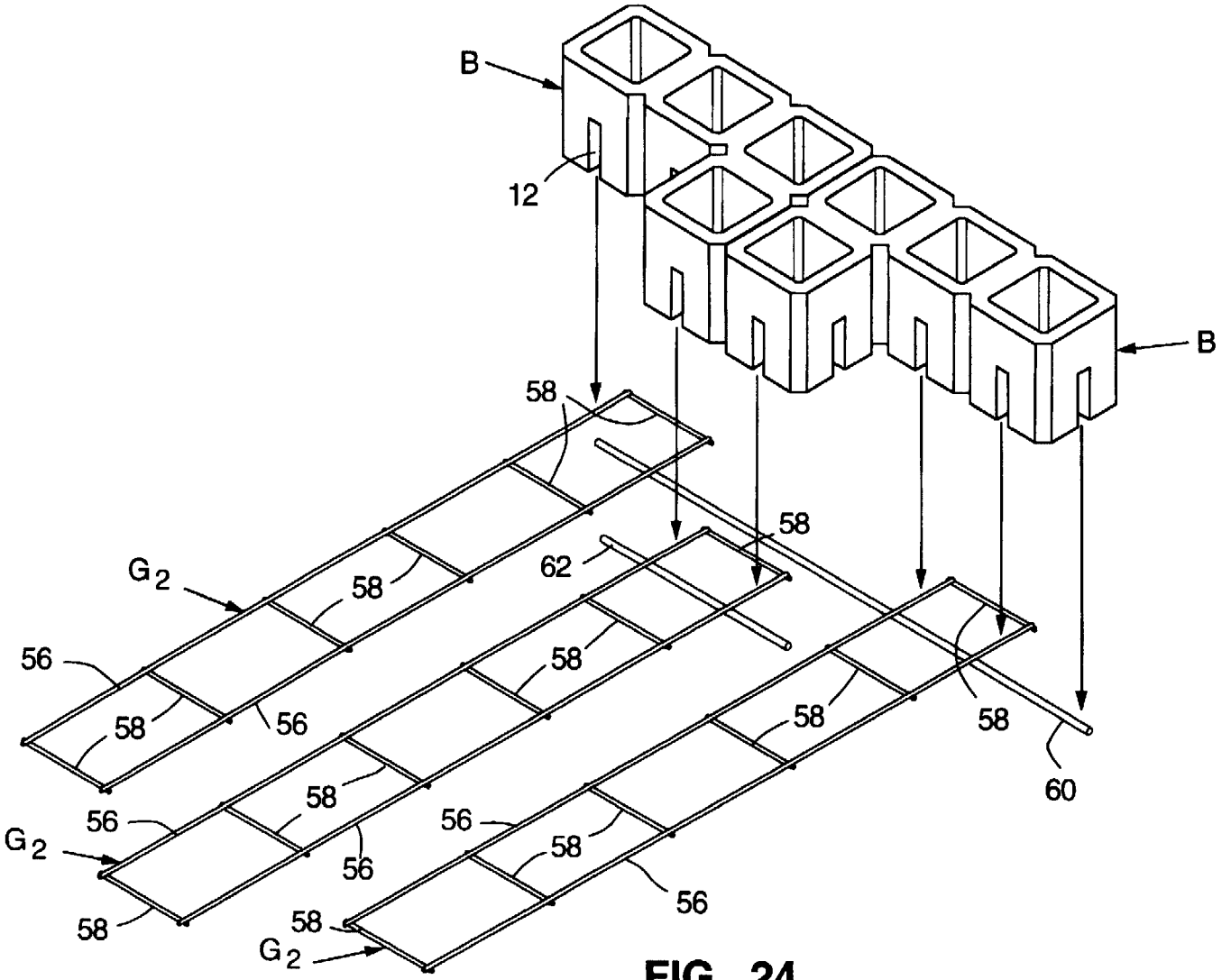
FIG. 24 is an exploded perspective view showing an assembly of blocks, gridworks and bars corresponding generally to that of FIG. 19, except that the blocks are inverted so that the grooves therein face downwardly and are engaged over the gridworks.
Figure 25:
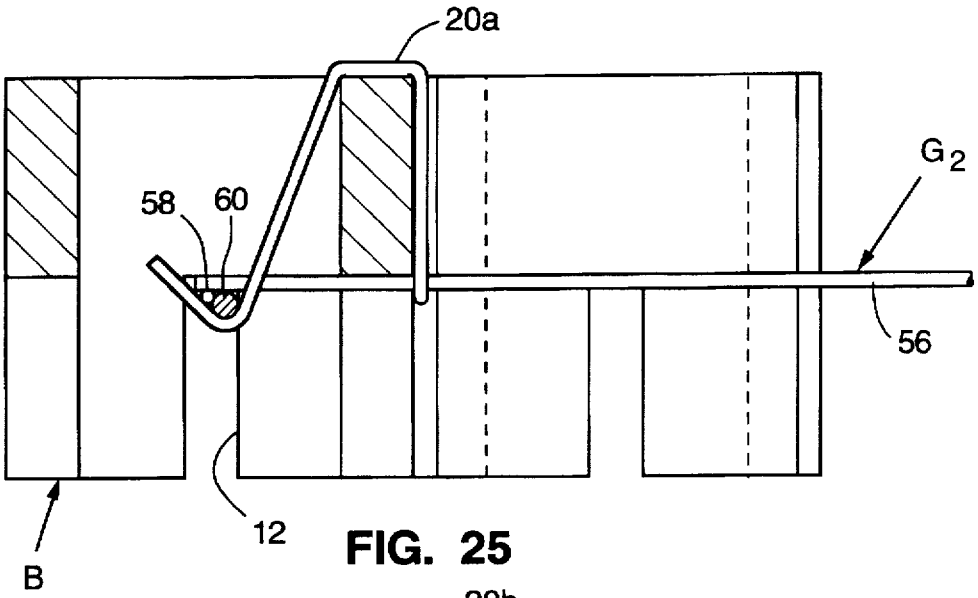
FIG. 25 is a cross-sectional elevational view showing the gridwork and block of the FIG. 24 assembly, with the gridwork fully engaged within the grooves of the block and a hanger holding the gridwork in place.

FIGS. 24 and 25 show a block wall and gridwork combination corresponding to that of FIGS. 19 to 21, except that the blocks are inverted relative to what is shown in FIG. 19 so that the grooves 12 therein extend downwardly. In FIG. 25, it will be seen that in the assembled condition the gridworks G2 are at the top of the grooves 12 and held in place by a wire connector or hanger 20*a* corresponding in construction to the hanger 20, except that it is proportioned to engage over a single wall thickness of the block B and under and around a bar 60 and cross-element 58.

Figure 26:
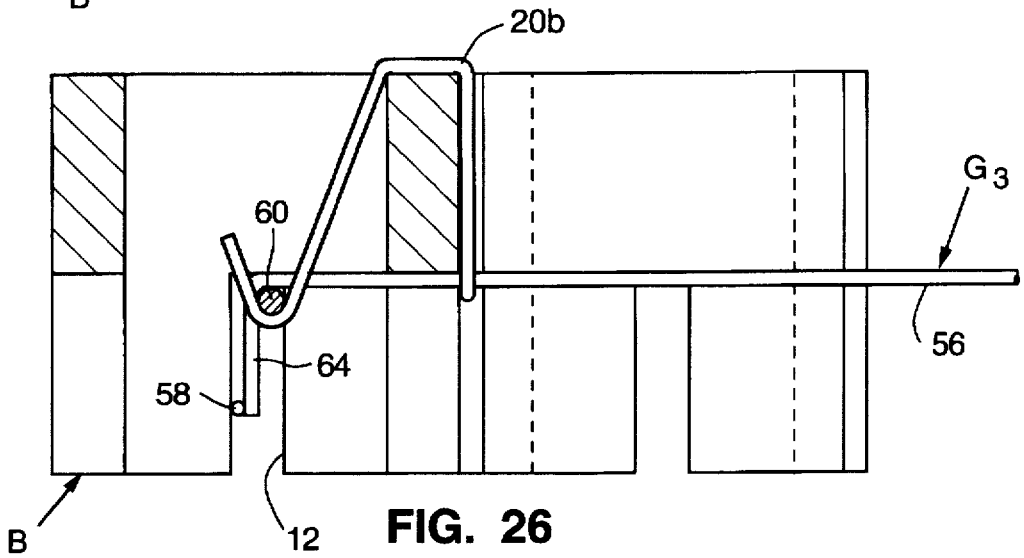
FIG. 26 is a cross-sectional elevational view similar to FIG. 25, showing how a gridwork with a bent-up end similar to that of FIGS. 22 and 23 may be received within a block inverted so that the grooves therein extend downwardly, with the retaining bar held in place by a hanger.

FIG. 26 shows a wall constructed according to that of FIGS. 22 and 23, except that the blocks B are inverted so that the grooves 12 therein face downwardly. As there shown, the gridwork G3 is held at the top of the groove 12 by a wire connector 20*b* corresponding generally to the connector 20, except that it is proportioned to engage over a single wall thickness of the block B and under and around the rod 60. As shown in FIG. 26, the bent portion 64 of the gridwork G3 extends downwardly.

Figure 27:
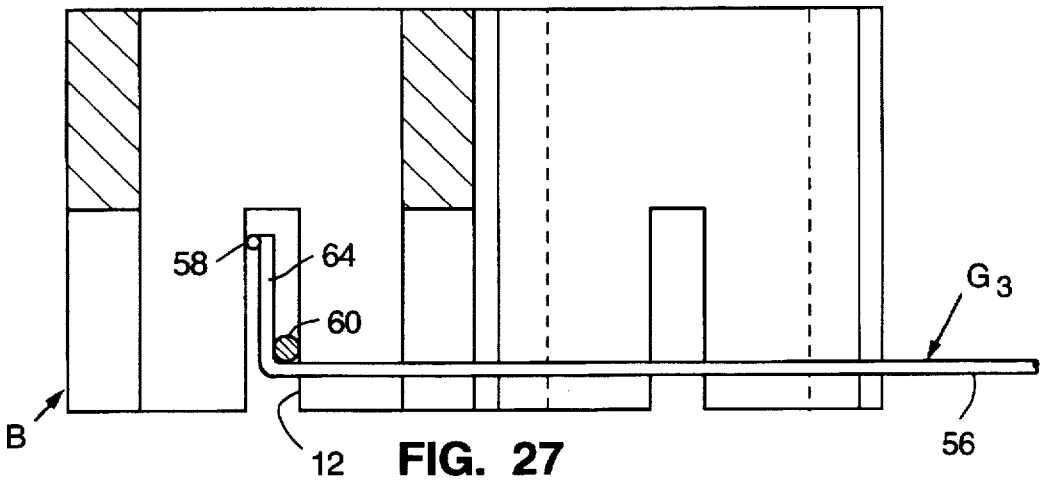
FIG. 27 is a cross-sectional elevational view similar to FIG. 26, showing the gridwork inverted relative to that illustrated in FIG. 26, with the retaining bar engaged on top of the gridwork and received within a downwardly extending groove of the block.

FIG. 27 shows a wall construction corresponding to that of FIG. 26 except that the gridwork G3 is disposed so that the bent portion 64 extends upwardly into the groove 12 of the block and the bar 60 rests on top of the longitudinal elements 56 of the gridwork. As assembled in FIG. 27, the bar 60 rests on the longitudinal element 56 and no connector is required to suspend the bar. Suitable stands, such as those shown in FIG. 3, could be used to support the gridwork G3 in elevated condition during the course of construction of the FIG. 27 wall. Like the walls of FIGS. 22–23 and 26, positioning of the bar 60 at the bend of bent-up portion 64 enables tension forces applied to the longitudinal element 56 to be transmitted to the bent-up portion 64 without loading the connection between the distal cross-element 58 received within the groove 12.

Figure 28:
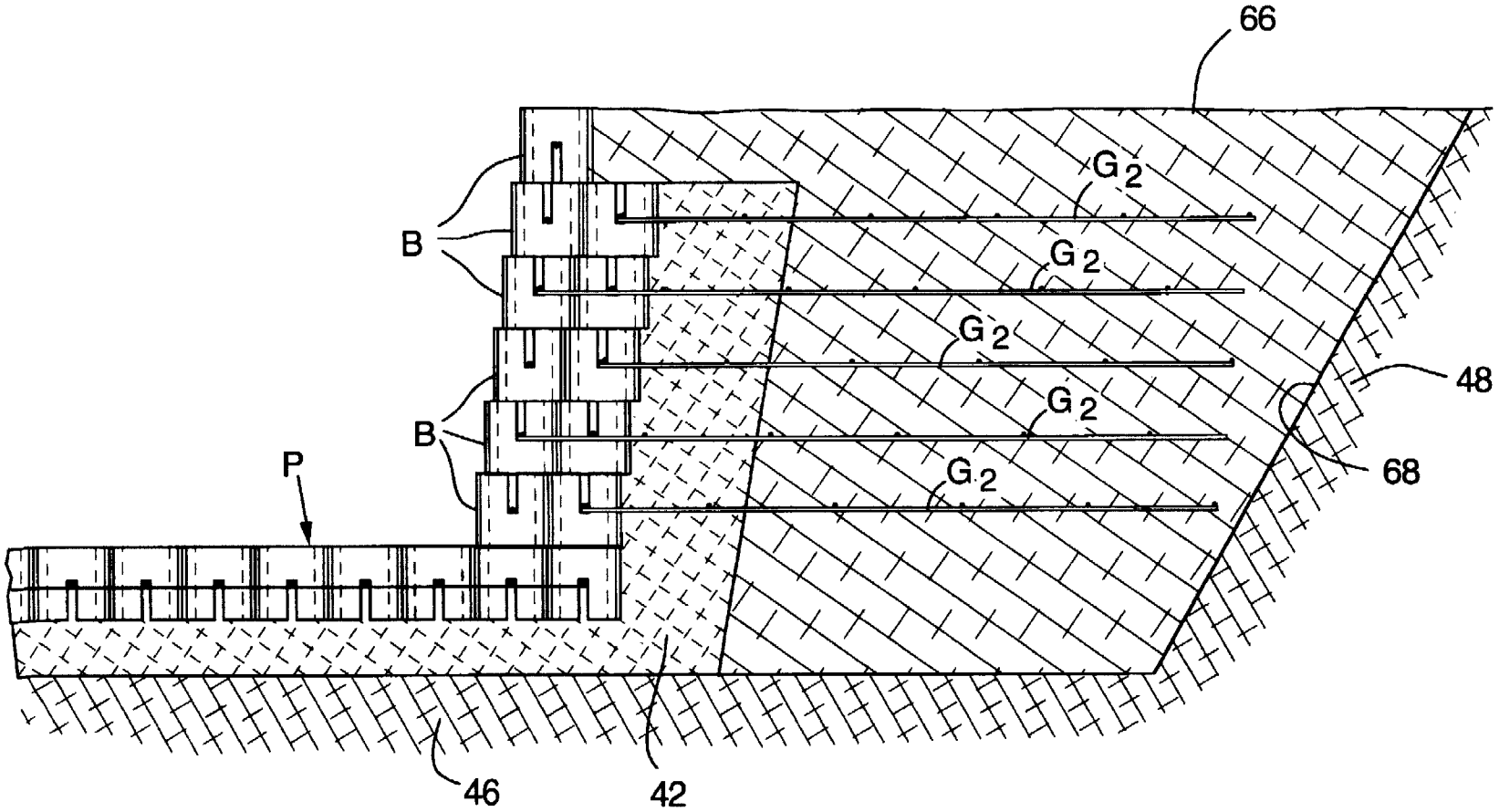
FIG. 28 is a cross-sectional elevational view of an earthen formation having a channel lined with panels of the type shown in FIG. 13 and a retaining wall constructed of an assembly of blocks and gridworks corresponding to that shown in FIGS. 19 to 21.

FIG. 28 shows an earthen formation similar to that of FIG. 16 having a base portion 46 and an upstanding, generally inclined portion 48. The base portion is covered with a panel P and a retaining wall comprised of blocks assembled as shown in FIGS. 19 to 21 and stacked upon one another in slightly staggered relationship is supported on the panel. Gridworks G2 are secured to the stacked blocks in the manner shown in FIGS. 20 and 21 and extend through drain rock 42 and into compacted backfill soil 66. The extension of the gridworks into the backfill soil serves to reinforce the soil and secure the face wall comprised of the stacked blocks against displacement. The cut face of the natural soil formations shown in FIG. 28 is depicted by the numeral 68.

CONCLUSION

From the foregoing description, it is believed apparent that the present invention enables the attainment of the objects initially set forth herein. In particular, it provides an integrated block construction wherein the blocks are interlocked with one another both through their configuration and through the gridwork engaged therewith. It also provides such a construction which may be lifted into place as a panel and is ideally suited for controlling erosion in earthen channels and for assembly into various types of erosion control systems and retaining structures for earthen formations. It also provides a structure wherein concentrated loads applied to a panel constructed from the integrated blocks are supported over a diverse area to provide increased support.

While preferred embodiments of the invention have been illustrated and described, it should be understood that the invention is not intended to be limited to the specifics of these embodiments, but rather is defined by the accompanying claims.

We claim:

1. A block for use in combination with a gridwork of intersecting elements which are engageable with the block to secure like blocks together in the construction of panels, said block comprising:

a) a body having at least one open cell extending therethrough from top to bottom; and b) grooves formed in the bottom of said body and extending upwardly into the block, said grooves intersecting the open cell of the block and being proportioned for receipt of the intersecting elements whereby the elements may extend across and intersect within the open cell of the block.

2. A block according to claim 1 wherein:

a) the block is of an L-shape viewed in plan and a plurality of open cells extend therethrough from top to bottom;

b) the cells are separated by webs of the block; and, c) certain of the grooves extend across webs.

3. A block according to claim 1 wherein the grooves are of a depth extending approximately one-half the distance between the top and bottom of the block.

4. An assembly for forming concrete panels, said assembly comprising:

a) a plurality of concrete blocks each having at least one open cell extending therethrough from top to bottom, grooves formed thereacross in intersecting relationship to said cell and a side wall complementally engageable with the side walk of another of said blocks; and, b) a gridwork having intersecting elements proportioned for receipt in said grooves and spaced to be received within the intersecting grooves of adjacent blocks when complementally engaged and to intersect within the open cells of the blocks to hold the blocks in such engagement.

5. An assembly according to claim 4 wherein the grooves are formed in the bottom of and extend upwardly into the blocks.

6. An assembly according to claim 5, wherein the grooves are of a depth extending approximately one-half the distance between the top and bottom of the blocks.

7. An assembly according to claim 5, wherein:

a) at least certain of the blocks are of an L-shape viewed in plan and a plurality of open cells extend therethrough from top to bottom;

b) the cells are separated by webs of the block; and, c) certain of the grooves extend across the webs.

8. An assembly according to claim 5 further comprising a hanger engagable over the blocks and under the gridwork to hold the gridwork within the grooves of the blocks.

9. A method of forming a panel comprised of concrete blocks, said method comprising:

a) providing a gridwork comprised of intersecting elements;

b) providing a plurality of concrete blocks having voids extending therethrough from top to bottom and grooves formed in the bottom thereof in intersecting relationship to the voids, said grooves being proportioned and arranged for complemental receipt of intersecting elements of the gridwork to hold the blocks in side-by-side relationship;

c) supporting the gridwork in an elevated condition; and, d) assembling the blocks over the gridwork in side-by-side relationship to engage the intersecting elements of the gridwork within the grooves of the blocks with the elements intersecting within the voids.

10. A method according to claim 9 further comprising extending a hanger over at least one of the blocks and into a cell to engage an intersecting element of the gridwork and hold the gridwork in elevated condition within the grooves of the blocks.

11. A method according to claim 9 further comprising grouting certain of the cells to hold the gridwork in elevated condition within the grooves of the blocks.

12. A method of covering the surface of an earthen formation, said method comprising:

a) providing a gridwork comprised of intersecting elements;

b) providing a plurality of blocks having intersecting grooves formed in and opening through one side thereof, said grooves extending across the blocks and being proportioned and arranged for complemental receipt of intersecting elements of the gridwork to hold blocks in side-by-side relationship;

c) supporting the gridwork in spaced relationship to the surface of the earthen formation; and, d) assembling said blocks over the gridwork in side-by-side relationship to engage the intersecting grooves of the blocks with intersecting elements of the gridwork.

13. A method according to claim 12 further comprising:

a) covering the surface of the earthen formation with drain material before supporting the gridwork in spaced relationship thereto; and, b) supporting the blocks on said drain material upon assembly of the blocks over the gridwork.

14. A method according to claim 12 wherein:

a) the surface of the earthen formation takes the form of a channel having a generally flat bottom portion and an outwardly divergent generally flat side portion;

b) the gridwork is comprised of bottom and side portions which are supported, respectively, in spaced generally parallel relationship to the bottom and side portions of the channel; and, c) the blocks are assembled over the bottom and side portions of the gridwork to line the channel.

15. A method according to claim 14 further comprising:

a) covering the bottom and side portions of the channel with drain material before supporting the gridwork in spaced relationship thereto; and, b) supporting the blocks on said drain material upon assembly of the blocks over the gridwork.

16. A method of covering the surface of an earthen formation, said method comprising:

a) providing a gridwork comprised of intersecting elements;

b) providing a plurality of blocks having intersecting grooves formed in and opening through one side thereof, said grooves extending across the blocks and being proportioned and arranged for complemental receipt of intersecting elements of the gridwork to hold blocks in side-by-side relationship;

c) supporting the gridwork in an elevated condition;

d) assembling said blocks over the gridwork in side-by-side relationship to engage the intersecting grooves of the blocks with intersecting elements of the gridwork and form a panel comprised of blocks held together by the gridwork;

e) lifting the panel to an elevated condition by engaging spaced portions of the gridwork with hoisting elements and elevating said elements; and, f) moving the panel while in the elevated condition to the situs of the earthen formation and depositing the panel to support the blocks on the formation with the gridwork disposed in spaced generally parallel relationship to the surface of the formation.

17. A concrete block panel comprising:

a) a gridwork having intersecting elements;

b) means supporting said gridwork in a suspended condition;

c) a plurality of concrete blocks supported on the gridwork, said blocks having intersecting grooves opening through and extending across one side thereof, said intersecting grooves being engaged over the intersecting elements of the gridwork to hold blocks in side-by-side relationship.

18. A panel according to claim 17, wherein:

a) the blocks have cells extending therethrough from top to bottom and the grooves extend across the blocks in intersecting relationship to the cells; and, b) elements of the gridwork intersect within the cells.

19. A panel according to claim 18, further comprising a hanger extending over at least one of the blocks and into a cell and engagement with an intersecting element of the gridwork to hold the gridwork in elevated condition within the grooves of the blocks.

20. A panel according to claim 17 wherein:

a) at least certain of the blocks are of an L-shape viewed in plan and a plurality of open cells extend therethrough from top to bottom;

b) the cells are separated by webs of the block; and, c) certain of the grooves extend across the webs.

21. A panel according to claim 17 wherein the grooves are formed in the bottom of and extend upwardly into the blocks.

22. A panel according to claim 21 wherein the grooves are of a depth extending approximately one-half the distance between the top and bottom of the blocks.

23. A panel according to claim 17 wherein reinforcing bars are secured to and extend upwardly from the panel, the panel further comprising subpanels stacked on top of said panel and received over said reinforcing bars, each subpanel comprising:

a) a second gridwork having intersecting elements;

b) means supporting second gridwork in a suspended condition;

c) a plurality of second concrete blocks supported on the second gridwork, said blocks having intersecting grooves engaged over the intersecting elements of the gridwork to hold blocks in side-by-side relationship.

24. An assembly for lining an earthen formation, said assembly comprising:, a) a gridwork of intersecting elements, said gridwork being supported in spaced generally parallel relationship to the earthen formation; and, b) a plurality of concrete blocks supported on the earthen formation, said blocks having intersecting grooves engaged over the intersecting elements of the gridwork to hold blocks in side-by-side relationship.

25. An assembly according to claim 24, wherein:

a) the blocks have cells extending therethrough from top to bottom and the grooves extend across the blocks in intersecting relationship to the cells; and, b) elements of the gridwork intersect within the cells.

26. An assembly according to claim 25, further comprising a hanger extending over at least one of the blocks and into a cell and engagement with an intersecting element of the gridwork to hold the gridwork in elevated condition within the grooves of the blocks.

27. An assembly according to claim 24, wherein:

a) at least certain of the blocks are of an L-shape viewed in plan and a plurality of open cells extend therethrough from top to bottom;

b) the cells are separated by webs of the block; and, c) certain of the grooves extend across the webs.

28. An assembly according to claim 24 wherein the grooves are formed in the bottom of and extend upwardly into the blocks.

29. An assembly according to claim 28, wherein the grooves are of a depth extending approximately one-half the distance between the top and bottom of the blocks.

30. An assembly for retaining an upstanding portion of an earthen formation and covering a base portion of the formation at the foot of the upstanding portion, said assembly comprising:

a) a gridwork of intersecting elements, said gridwork being supported in spaced generally parallel relationship to the base portion of the earthen formation; and, b) a first plurality of concrete blocks supported on the base portion of the earthen formation, said blocks having intersecting grooves engaged over the intersecting elements of the gridwork to hold blocks in side-by-side relationship;

c) a second plurality of concrete blocks stacked upon one another and extending over the upstanding portion of the earthen formation, said second plurality of blocks being supported on the first plurality of blocks; and, d) means securing the second plurality of blocks against displacement relative to the upstanding portion of the formation.

31. An assembly according to claim 30 wherein:

a) the second plurality of blocks have intersecting grooves formed therein; and, b) the means securing the second plurality of blocks against displacement relative to the formation comprise reinforcing mats having intersecting elements complemental with the intersecting grooves of the second plurality of blocks, said mats having proximal portions with intersecting elements engaged within the intersecting grooves of the second plurality of blocks and distal portions extending toward the earthen formation.

32. An assembly according to claim 30 further comprising drain material disposed between the earthen formation and the first and second plurality of blocks, said first plurality of blocks resting on the drain material therebeneath.

33. An assembly according to claim 30 wherein the upstanding portion of the earthen formation terminates in a surface and is capped with an assembly comprising:

a) a gridwork of intersecting elements, said gridwork being supported in spaced generally parallel relationship to said surface of the earthen formation; and, b) a third plurality of concrete blocks supported on said surface of the earthen formation, said blocks having intersecting grooves engaged over the intersecting elements of the gridwork to hold blocks in side-by-side relationship.

34. A method of constructing a retaining wall for an earthen formation, said method comprising:

a) providing a plurality of concrete blocks having first grooves extending thereacross and second grooves extending through one side thereof in intersecting relationship to said first grooves;

b) assembling said blocks in front of the formation in side-by-side relationship with the first grooves of adjacent blocks aligned;

c) providing gridworks having paired longitudinal elements engageable within the second grooves of adjacent blocks disposed in side-by-side relationship and a cross-element engageable within the first grooves of said adjacent blocks;

d) engaging said gridworks with the assembled blocks so as to extend from said one side thereof into the earthen formation with the paired longitudinal elements engaged-within the second grooves of adjacent blocks and the cross-element engaged within the first grooves of said adjacent blocks.

35. A method according to claim 34, further comprising extending a bar across the first grooves of adjacent blocks to span the blocks.

36. A method according to claim 35 wherein the concrete blocks have open cells extending therethrough from top to bottom and the first and second grooves intersect the cells, said method further comprising filling at least certain of the cells with a medium to hold the gridworks and bar in place within the first grooves.

37. A method according to claim 35 wherein the bar is disposed to engage the gridwork and resist pullout of the gridwork from the blocks.

38. A method according to claim 34 wherein the longitudinal elements define a plane therebetween and are formed with bent-up end portions which carry the cross-element and extend out of said plane.

39. A method according to claim 38 further comprising extending a bar across the first grooves of adjacent blocks to one side of said bent-up ends to resist pull-out of the gridwork from the blocks and span the blocks.

40. A retaining wall for an earthen formation, said wall comprising:

a) a plurality of concrete blocks having first grooves extending thereacross and second grooves extending through one side thereof in intersecting relationship to said first grooves, said blocks being assembled in front of the formation in side-by-side relationship with the first grooves of adjacent blocks aligned and said one side facing the formation; and, b) gridworks having paired longitudinal elements engaged within the second grooves of adjacent blocks disposed in side-by-side relationship and a cross-element fixed between said longitudinal elements and engaged within the first grooves of said adjacent blocks to span the blocks, said gridworks extending from said one side of the blocks and into the earthen formation.

41. A retaining wall according to claim 40, further comprising a bar extending across the first grooves of adjacent blocks to span the blocks.

42. A retaining wall according to claim 41 wherein the concrete blocks have open cells extending therethrough from top to bottom and the first and second grooves intersect the cells, said wall further comprising a fill means disposed within at least certain of the cells to hold the gridwork and bar in place within the first grooves.

43. A retaining wall according to claim 41 wherein the bar is disposed to engage the gridwork and resist pullout of the gridwork from the blocks.

44. A retaining wall according to claim 40 wherein the longitudinal elements define a plane therebetween and are formed with bent-up end portions which carry the cross-element and extend out of said plane.

45. A retaining wall according to claim 44 further comprising a bar extending across the first grooves of adjacent blocks to one side of said bent-up ends to resist pull-out of the gridwork from the blocks and span the blocks.

46. A retaining wall for an earthen formation, said wall comprising:

a) a plurality of concrete blocks having first grooves extending thereacross and second grooves extending through one side thereof in intersecting relationship to said first grooves, said blocks being assembled in front of the formation in side-by-side relationship with the first grooves of adjacent blocks aligned and said one side facing the formation;

b) a gridwork having paired longitudinal elements engaged within the second grooves of one of the blocks and a cross-element fixed between said longitudinal elements and engaged within the first groove of said one block, said gridwork extending into the earthen formation; and, c) a bar received within and extending across the first grooves of adjacent blocks to span the blocks.

47. A retaining wall according to claim 46 wherein the bar is disposed to engage the gridwork and resist pullout of the gridwork from the blocks.

48. A retaining wall according to claim 46 wherein the longitudinal elements define a plane therebetween and are formed with bent-up end portions which carry the cross-element and extend out of said plane.

49. A retaining wall according to claim 48 wherein the bar engages the bent up portions to resist pullout of the gridwork from the blocks.

50. A retaining wall according to claim 46 wherein the concrete blocks have open cells extending therethrough from top to bottom and the first and second grooves intersect the cells, said wall further comprising a fill means disposed within at least certain of the cells to hold the gridwork and bar in place within the first grooves.

51. A method of retaining an earthen formation, said method comprising:

a) providing a plurality of concrete blocks having first grooves extending thereacross and second grooves extending through one side thereof in intersecting relationship to said first grooves, b) assembling said blocks in front of the formation in side-by-side relationship with the first grooves of adjacent blocks aligned and said one side facing the formation;

c) providing a gridwork having paired longitudinal elements engageable within the second grooves of the blocks and a cross-element fixed between said longitudinal elements and engageable within the first grooves of said blocks;

d) engaging the gridwork with one of the assembled blocks so as to extend from said one side thereof into the earthen formation with the paired longitudinal elements engaged within the second grooves of said one block and the cross-element engaged within the first groove of said one block;

c) extending a bar across the first grooves of adjacent blocks to span the blocks.

52. A method according to claim 51 wherein the bar is disposed to engage the gridwork and resist pullout of the gridwork from the blocks.

53. A method according to claim 51 wherein the longitudinal elements define a plane therebetween and are formed with bent-up end portions which carry the cross-element and extend out of said plane.

54. A method according to claim 53 wherein the bar engages the bent up portions to resist pullout of the gridwork from the blocks.

55. A method according to claim 51 wherein the concrete blocks have open cells extending therethrough from top to bottom and the first and second grooves intersect the cells, said method further comprising filling at least certain of the cells with a medium to hold the gridwork and bar in place within the first grooves.

* * * * *